United States Patent [19]

Merrifield

[11] 4,085,529

[45] Apr. 25, 1978

[54] SNOWSHOE

[76] Inventor: Fred C. Merrifield, 8746 Overlade Dr. W., Bellevue, Wash. 98004

[21] Appl. No.: 743,335

[22] Filed: Nov. 19, 1976

[51] Int. Cl.[2] ..... A43B 5/04

[52] U.S. Cl. ..... 36/125

[58] Field of Search ..... 36/122; 36/123; 36/124; 36/125

[56] References Cited

U.S. PATENT DOCUMENTS

| | | | |
|---|---|---|---|
| 3,555,708 | 1/1971 | Goupil | 36/122 |
| 3,636,643 | 1/1972 | Lundquist | 36/125 |

FOREIGN PATENT DOCUMENTS

| | | | |
|---|---|---|---|
| 453,083 | 12/1948 | Canada | 36/125 |
| 906,522 | 8/1972 | Canada | 36/123 |
| 918,698 | 1/1973 | Canada | 36/123 |

*Primary Examiner*—Patrick D. Lawson

*Attorney, Agent, or Firm*—Christensen, O'Connor, Johnson & Kindness

[57] ABSTRACT

A snowshoe has a tubular, elongated frame with spaced side portions and rounded toe and heel portions. A plurality of discrete tie strips bind a heel decking and a toe decking comprised of a resin-impregnated nylon fabric to the frame. An adjustable frame cross member is positioned in a space between the toe and heel decking and carries the snowshoe binding. The binding is constructed to loosen the heel strap on the wearer's boot when the heel is tilted forwardly and upwardly while walking in the snowshoe to allow lateral movement of the wearer's heel but securely holds the boot in the desired position when the heel is rotated back down into the rest position on the snowshoe.

34 Claims, 8 Drawing Figures

SNOWSHOE

BACKGROUND OF THE INVENTION

The present invention relates to a new and improved snowshoe and more particularly to an improved snowshoe frame, an improved decking, improved means for tieing the decking to the frame, an improved binding construction, and means for coupling the binding to the snowshoe.

A wide variety of snowshoes are commercially available. A description of many of these snowshoes is included in an article "How to Buy Snowshoes — Fastenings, Fittings and Function," *Backpacker,* volume 3, #4, pages 62–71, Winter Edition, 1976. Many of these snowshoes employ wooden frames that are subject to warping and to structural fatigue, especially at bends in the frame. Wooden frames also require constant care and refinishing to prevent them from absorbing moisture during use. Metal frames are much more desirable; however, they are more expensive than wooden frames and, if made light enough, tend to flex under loading rather than providing a rigid framework for the snowshoe.

The webbing used with many prior art snowshoes is a network of woven strands of rawhide or, in some cases, a synthetic polymeric material. The rawhide bindings tend to stretch when wet, loosening the webbing, and thus require constant adjustment. The synthetic material tends to stretch and abrades against itself where it overlaps, and thus is subject to breakage. Some of the recently available snowshoes have substituted a fabric decking for the conventional webbing. However, the fabric is still laced to the snowshoe frame, usually with a continuous strand of lacing material, the breaking strength of which exceeds the tear strength of the fabric. Thus the material can tear away from the fabric causing webbing failure. When the webbing or continuous lacing of such prior art snowshoes breaks, the webbing or lacing will loosen from the frame, eventually releasing a major portion or all of the webbing or decking from the frame, as well as loosening or releasing the binding from the snowshoe, rendering the snowshoe unusable.

The bindings of presently available snowshoes can be adjusted for a given wearer's boot and some bindings incorporate crude hinges to allow the boot heel of the wearer to swing upwardly and forwardly during use. Other bindings have more sophisticated hinges, but are significantly more expensive to produce than the relatively crude conventional hinges. However, at least one prior art binding is constructed to allow only the aforementioned swinging movement about the hinge in the binding and does not allow lateral movement of the boot heel in the binding during use. When a snowshoer changes from a side hill traverse of one slope to a side hill traverse of the opposite slope, he many times desires to change his boot position in the binding. However, with prior art bindings he is required to stop and readjust his bindings to provide the proper boot angle relative to the longitudinal dimension of the snowshoe. Some of the prior art bindings in fact will not even accommodate such lateral adjustments of the boot heel within the binding. Other prior art bindings do allow lateral heel movement, but do not restrain the boot at any boot position, thus rendering the snowshoe unstable and relatively hard to control.

Another problem with prior art bindings is that they are not readily adjustable to varying boot sizes but require tedious relacing and, in essence, reconstruction of the binding to fit different sizes. Moreover, prior art bindings do not generally allow longitudinal adjustment of the boot on the snowshoe without major reconstruction of the binding.

To solve the problems mentioned above and other problems that are apparent to snowshoe users, it is a broad object of the present invention to provide an improved snowshoe that is engineered to accept and use current technology in materials and construction and to provide a snowshoe that is better suited to its intended use than are the prior art snowshoes. More specific objects of the present invention are to provide an improved frame that requires little or no care, that will not warp, that is not subject to structural fatigue under prolonged use, that is easily manufactured, and that can be assembled with a very minimum of labor; to provide a rigidified frame and cooperating binding that will not allow the snowshoe to cant sidewardly about a longitudinal fore and aft axis relative to the wearer's boot; to provide an improved binding that is easily adjustable both in width and longitudinal locaton on the snowshoe to accommodate varying boot sizes for the same snowshoe; to provide an improved binding that allows lateral heel movement of the boot without lateral displacement of the toe section of the boot on the snowshoe during use in order to cant the boot relative to the longitudinal axis of the snowshoe while the user is walking; to provide a self-aligning snowshoe that will track straight on level terrain after each step even though the boot heel may have been laterally displaced during the previous step; to provide a rigid gripping member on the frame for improving traction regardless of the boot position relative to the shoe and the snow surface; to provide an improved decking for increased flotation on the snow, and a decking with significantly increased durability over those of the prior art; to provide an improved means for tieing the decking to the frame to eliminate problems associated with webbing or lacing breakage on prior art snowshoes; to provide an improved means for tieing the decking to the shoe that is readily adaptable to field repair without the need for substantial quantities of additional lacing material or special tools; to provide an improved tieing means that will not tend to tear the decking at its point of attachment to the decking; to provide such an improved tieing means that is wear resistant; to provide such an improved tieing means that, upon even partial failure, will not seriously hamper the use of the shoe; and to provide a snowshoe design that is readily adaptable to production and sale in a kit form for assembly by the consumer, thereby lowering the capital outlay required to outfit the consumer in a snowshoe.

SUMMARY OF THE INVENTION

In accordance with the foregoing objects, and other objects that will become apparent to one of ordinary skill in the art, the present invention provides several novel features that, when used together, provide a snowshoe design significantly advanced over that of the prior art snowshoes and, when used individually, will improve even existing snowshoes. In a first aspect, an improved decking and means for tieing the decking to a rigid snowshoe frame that includes a pair of spaced side members, a toe portion and a heel portion is provided. The improved decking has a peripheral portion sized to fit within at least a portion of the frame and has a plurality of spaced apertures in its peripheral portion adjacent the frame. A plurality of discrete tie members, spaced from each other, each pass through an associated one of the apertures in the decking and is wrapped around the frame to secure the decking to the frame and to position the decking between the side members of the frame. Preferably, each of the tie members is a strip of flexible synthetic material. A self-locking electrical cable tie is the most preferably used tie member in this aspect of the invention since it provides an easily manipulated discrete member for tieing the decking to the frame. If one of the discrete tie members breaks or is severed by abrasion on a sharp object, only the portion of the decking held by that particular tie will be loosened from the frame. All adjacent portions of the decking will be held securely to the frame, thus even upon partial failure of the tieing system, the use of the snowshoe is not significantly hampered. Additionally, spare tie members can easily be carried by the wearer of the shoe. A broken tie member can be replaced with a minimum of effort and lost time and, in many instances, will not even require the wearer of the shoe to remove the shoe from his boot to repair it.

In another aspect of the present invention, a snowshoe frame is provided with a decking sized to fit within at least a portion of the frame. The decking is tied to the frame and is capable of stretching in the transverse direction relative to the snowshoe while being relatively inelastic in the longitudinal direction relative to the snowshoe. Because the decking will not stretch in the longitudinal direction, no loss in flotation occurs due to ballooning or billowing of the decking. However, the ability of the decking to stretch in the transverse direction relative to the shoe will allow it to deflect should the wearer of the shoe step on an object protruding from the ground. Thus the decking is protected from puncture while providing a stable, buoying surface on the snow. A preferable decking is composed of a resin-impregnated fabric that is so woven and to be elastic in the transverse direction as it is mounted on the shoe but to be relatively inelastic in the longitudinal direction.

In a third aspect of the present invention, the snowshoe has a frame including spaced side members, a rounded forward member having rearwardly extending portions affixed to the side members and a heel member having forwardly extending portions affixed to the side members. A rigid cross member extends transversely between the side members and has each of its ends positioned adjacent one of the side members. First and second means releasably couple the ends of the rigid cross member to respectively adjacent ones of the side members. The first and second means normally secure the rigid cross member to the frame in fixed relationship but are capable of releasing the rigid cross member from the frames so that it can be moved in the longitudinal direction relative to the snowshoe to adjust the longitudinal positioning of the rigid cross member on the shoe. Once the rigid cross member is secured to the side members, it reinforces and rigidifies the frame to inhibit twisting and flexing during use. Also, the cross member is positioned relative to the binding so that the ball of a foot of a wearer resides directly over the rigid cross member, thus transferring the weight of the wearer directly to the frame member and thus evenly distributing the weight through the tieing means over the entire decking. Moreover, the fore and aft adjustability of the cross member allows adjustment of the lateral pivot axis to alter the length of the snowshoe in front of the boot, thereby changing its balance as desired for uphill and downhill movement.

In a fourth aspect of the present invention, a cross member extends transversely between spaced side members of the snowshoe frame. The cross member is rigidly affixed to the side portions and is positioned on the snowshoe so as to reside under the location corresponding to the ball of the foot of a wearer of the snowshoe. The snowshoe binding is connected to the cross member for swinging movement about an axis oriented generally transversely relative to the shoe. Preferably, the binding is so connected to the cross member as to position the transversely oriented rotational axis forwardly of the upper, forward edge of the cross member and most preferably above and forwardly of the upper, forward edge of the cross member. In this manner, when the rear portion of the binding, which includes a heel strap passed around the heel of a boot positioned in the binding, is rotated upwardly and forwardly about the transversely oriented axis as the wearer's boot heel is raised, the heel strap of the binding is loosened. When the heel strap is so loosened, the boot heel can be moved laterally to cant the boot relative to the longitudinal axis of the snowshoe. When the heel is lowered to its rest position on the shoe, the binding again tightens on the boot to prevent lateral movement of the boot heel when the boot is in its rest position on the snowshoe. This feature allows purposeful canting of the boot relative to the showshoe and, in level terrain, provides self-alignment to maintain the snowshoes in parallel relationship.

In still another aspect of the present invention, a novel snowshoe frame is provided which includes a tubular heel member having a rounded rearward end and forwardly extending spaced side portions and a tubular toe member having a rounded forward end and rearwardly extending spaced side portions. The spaced side portions of one of the heel and toe members are telescopically engaged in the spaced side portions of the other of the heel and toe members. A stop means is associated with one of the members for limiting the extent of inward telescopic engagement of the members to provide a longitudinally stable snowshoe frame. In a preferred embodiment, decking is sized to fit between the side portions of the frame and has separate toe and heel portions. The toe and heel portions of the decking are fixed to the respective toe and heel frame members and are affixed to each other to prevent separation of the decking portions in the longitudinal direction relative to the snowshoe, thereby maintaining the frame members in telescoped relationship against the stop means. This frame is easily manufactured, is easily assembled, and requires no tools for assembly other than those necessary for tieing the toe and heel portions of the decking to the frame and to each other.

BRIEF DESCRIPTION OF THE DRAWINGS

A better understanding of the present invention can be derived by reading the ensuing specification in conjunction with the accompanying drawings wherein.

DETAILED DESCRIPTION

Figure 1:
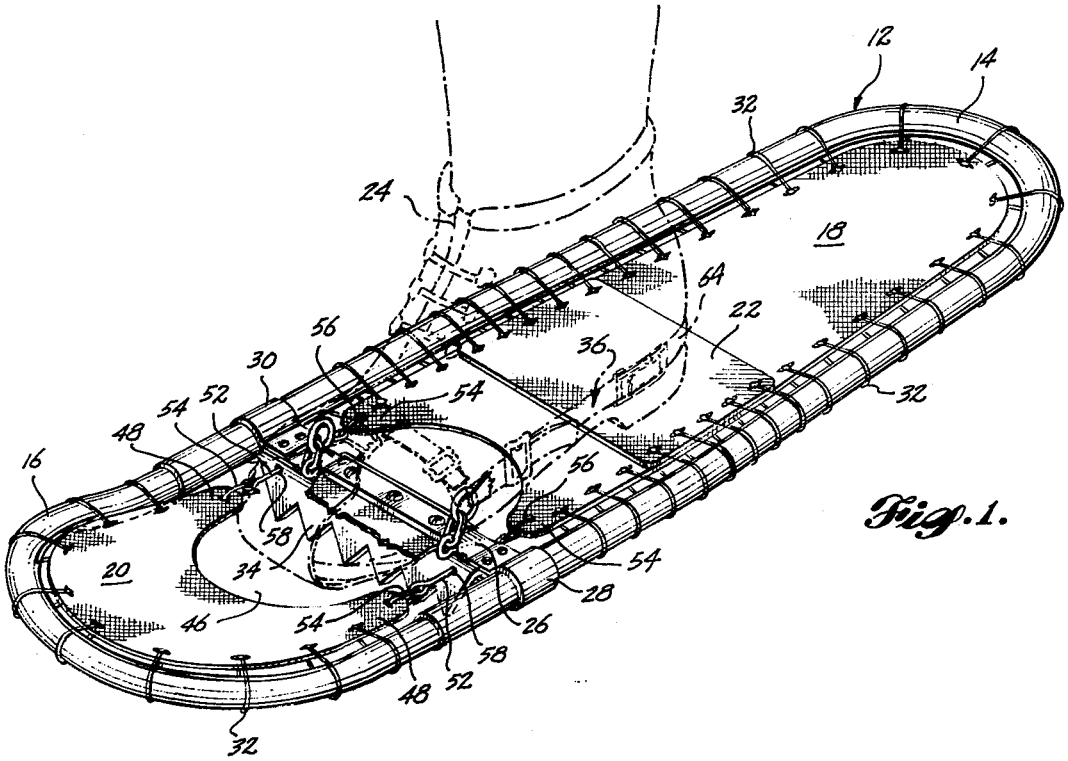
FIG. 1 is an isometric view of the snowshoe of the present invention looking rearwardly along the shoe from the top and showing a boot positioned thereon in phantom outline.
Figure 2:
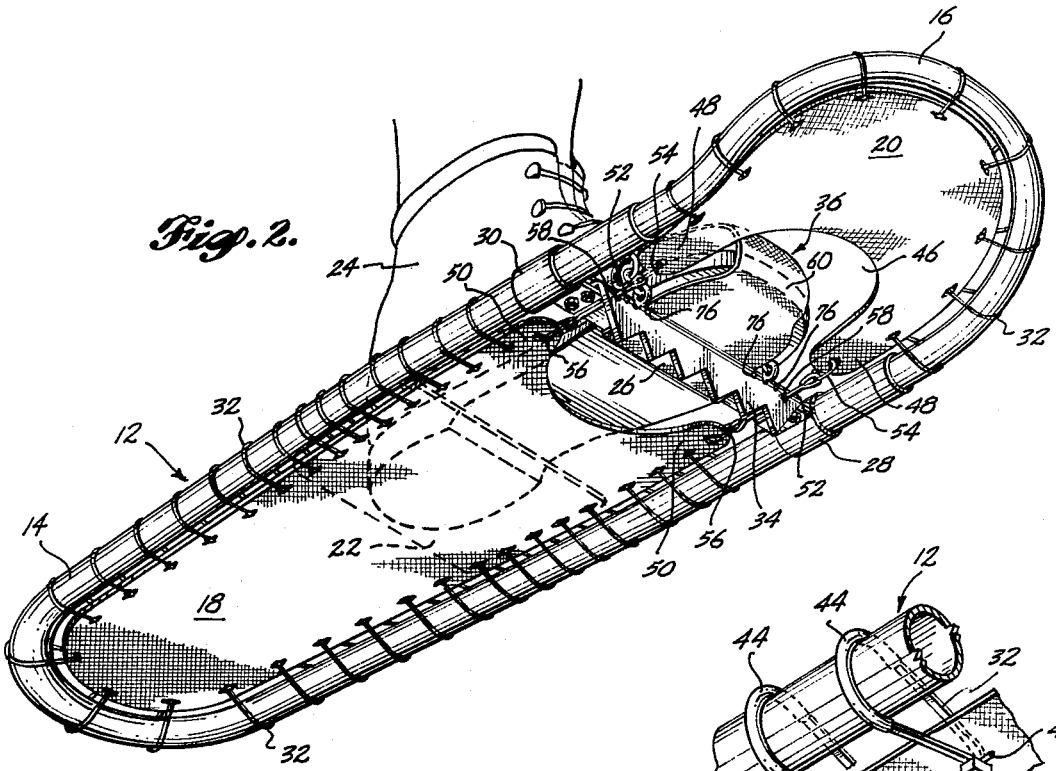
FIG. 2 is an isometric view of the snowshoe of the present invention looking rearwardly along the shoe from the bottom.

Referring first to FIGS. 1 and 2, the snowshoe frame, generally designated 12, includes a heel member 14 and a toe member 16. Rather than a webbing, the snowshoe of the present invention employs a resin impregnated fabric decking. The decking is divided into a heel decking 18 sized to fit within the heel member 14 of the frame and toe decking 20 sized to fit within the toe member 16 of the frame. A decking reinforcing member 22 is superposed on the heel decking 18 at the location normally occupied by the heel of a boot 24 (shown in phantom outline) of the wearer of the snowshoe.

The heel decking 18 and the toe decking 20 are lashed to the frame 12 by a plurality of discrete tie members 32, which in the preferred embodiment are loops of flexible polymeric material that wrap around the outer edges of the frame, are threaded through slots in the peripheral portion of the decking and back toward the frame so as to form a continuous, closed loop. These individual ties, as opposed to the lacing or webbing of prior art snowshoes, provide significant advantage in the ease of assembly, durability, failure resistance, repair of the snowshoe, and protect the integrity of the decking, as will be seen below.

A cross member 26 is positioned in the space between the forward end of the heel decking and the aft end of the toe decking and is rigidly affixed to the side portions of the frame 12 by clamps 28 and 30. Integral with the cross member 26 is a downwardly extending claw or grouser 34 that bites into the snow to provide added traction, especially when the snowshoe is being used to climb a grade. The binding, generally designated 36, is coupled to the cross member 26 and is positioned relative to the cross member such that the ball of the foot of the wearer resides directly over the cross member. Thus the weight of the wearer is transmitted through the cross member 26 to the frame 12 and distributed over the decking rather than being concentrated on the central portion of the decking. The binding 36 has additional advantages that will be discussed in detail below.

The snowshoe of the present invention is depicted in a preferred embodiment and can be characterized in the context of the previously mentioned *Backpacker* article as a modified bear claw type snowshoe. That is, the snowshoe is a relatively narrow, elongated structure relative to the width and length of the boot of the wearer. Although the snowshoe is depicted in its preferred form, it is to be understood that the features of the snowshoe of the present invention can be employed alone or in combination with any of a variety of snowshoe types.

Figure 3:
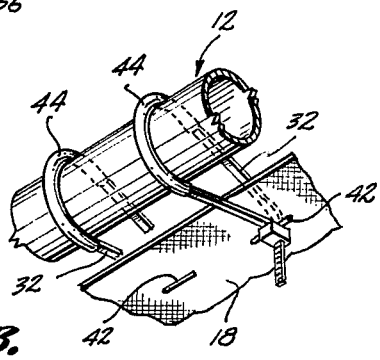
FIG. 3 is a greatly enlarged isometric view of one form of the discrete tie members employed to secure the webbing to the frame.
Figure 4:
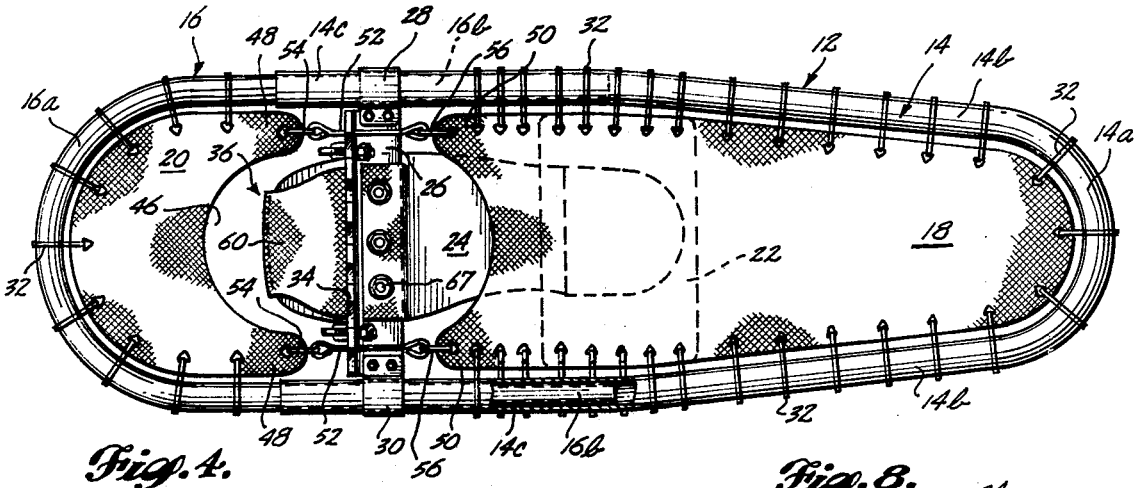
FIG. 4 is a bottom view of the snowshoe.

Referring now to FIGS. 3 and 4, both the heel member 14 and toe member 16 of the frame are tubular in construction and are preferably manufactured from a drawn aluminum tubing having a circular cross-section. The heel member has an arcuate rearward end 14*a* with forwardly extending side portions that are spaced from each other. The forward end 14*c* of the side portions are substantially parallel to each other while the rearward sections 14*b* of the side portions converge rearwardly to join respective ends of the rounded rearward portion 14*a*. The centerline of the tubing of the heel member lies substantially in a single plane. The toe member 16 of the frame has a rounded forward section 16*a* and two spaced, rearwardly extending portions 16*b*. The forward section 16*a* of the toe member 16 is turned upwardly relative to the rearwardly extending side sections 16*b* to provide an upswept toe portion. The outside diameter of the side sections 16*b* and, in the preferred embodiment, of the toe member 16 is slightly less than the inside diameter of the forwardly extending, substantially parallel sections 14*c* of the heel member 14. The rearwardly extending sections 16*b* of the toe member are telescoped into the forwardly extending sections 14*c* of the heel member 14 to form a rigid, unified frame. The rearward end of the rearwardly extending parallel sections 16*b* of the toe member abut the internal side walls of the heel member 14 at the juncture of the parallel sections 14*c* and the rearwardly converging sections 14*b*. Thus the bend or curvature in the heel member at the junction of the parallel and rearwardly converging sections of the heel member forms a stop to limit the rearward telescoping travel of the toe member into the heel member, and thus defining the longitudinal dimension of the snowshoe from the rearward rounded portion 14*a* of the heel member to the forward rounded portion 16*a* of the toe member. As just described, it is clear that the radius of curvature of the rearward rounded portion 14*a* of the heel member is slightly less than the forward rounded portion 16*a* of the toe member so as to provide the snowshoe frame 12 with a wider track at the forward and central portions of the frame and a narrowing track at the rearward end of the frame. As will be seen later, the heel and toe members of the frame are held in telescoped relationship by the heel and toe decking 18 and 20.

The cross member 26 is a rigidifying frame member and comprises a horizontal bar with an integral, downwardly extending flange at its forward end. The bottom edge of the downwardly turned forward edge is serrated in sawtooth fashion to provide a traction member or claw 34 that can bite into the traversed surface when it is icy or when it consists of hardpacked snow. The cross member 26 spans the distance between the substantially parallel side portions of the frame 12 and terminates just short of the opposite side portions of the frame. Split collar clamps 28 and 30 are positioned about the parallel side portions 14*c* of the heel member. The collars have integral, inwardly extending, parallel flanges positioned on each side of the collar split that extend over the upper and lower edge portions of the horizontal portion of the cross member 26. These flanges are clamped into place by bolts or other suitable fasteners that extend through aligned apertures 40 in the parallel flanges and in the ends of the horizontal portion of the cross member. When the clamp bolts are securely tightened, the cross member 26 is held in rigid relationship to the entire frame, bracing it in the transverse direction.

The ability to adjust the fore and aft location of the cross member is significant as it allows the wearer to adjust the length of the snowshoe forward of the binding location, i.e., forward of the pivot axis of the binding relative to the shoe. Thus, for an uphill traverse, a lesser length of shoe in front of the boot can be obtained to provide better hill climbing ability. Likewise, when moving downhill, the length of the snowshoe in front of the boot can be increased to raise the forward portion of the shoe during each step to minimize the possibility of the snowshoe toe catching in the snow.

Normally, the cross member 26 will be oriented orthogonally to the substantially parallel side portions 14c of the frame. However, as can be seen by reference to FIG. 5, if desired the cross member 26 can be canted relative to that orthogonal orientation to allow the boot of a wearer to be adjusted relative to the longitudinal direction of the snowshoe. As the binding is directly attached to the rigid cross member 26, this adjustment feature will allow the binding to accommodate a given person's normal walking stance, whether his feet are normally parallel, whether they are toe-out, that is, whether the normal stance is divergent from rear to front, or whether the wearer has a toe-in stance, that is, convergent from rear to front. The canting of the cross member 26 is made possible by providing the aligned apertures 40 (FIG. 6) in the cross member 26 with a larger diameter than those in the parallel flanges of the split collar clamps 28 and 30, thus allowing the cross member canting adjustment prior to tightening the clamping bolts on the collar clamps 28 and 30.

Referring again to FIGS. 1 through 4, the heel decking 18 of the snowshoe is sized to fit within the heel member 14 of the frame 12. The side and rearward peripheral edges of the heel decking are spaced inwardly from the inner portion of the rear and side sections of the heel member 14. A plurality of equally spaced slots 42, oriented parallel to the peripheral edge or, on the rearward curved portion, parallel to a tangent to the curved peripheral edge, are positioned a small distance inwardly from the peripheral edge of the heel decking. A plurality of individual tie strips, the characteristics of which will be discussed in more detail below, are wrapped about the adjacent portion of the frame, threaded through a respective slot and then fastened, in the preferred embodiment to itself, to form a closed loop, each of which fastens a portion of the heel decking to the frame.

An enlarged view of the tie members (FIG. 3) shows the slots 42 in a portion of the heel decking 18 and the tie members 32 wrapped around the heel member 14 of the frame and strung through the slots 42 in the decking. The preferred tie members 32 comprise what are commonly referred to as electrical cable or wire bundle ties. These cable ties are normally flat strips of synthetic polymeric material, commonly a nylon material, that is molded to include a pawl-like mechanism on one end and mating serrations on the opposite end to form a ratchet-like member. When the ratchet end of the cable tie is inserted into the pawl-like mechanism and tightened down, the cable ties will not separate. The preferred cable tie is commercially available and is composed of a flexible nylon material filled with carbon. The carbon-filled nylon cable tie is very resistant to ultraviolet degradation and thus has a very long life expectancy. The long life expectancy is especially advantageous for a snowshoe to be used at high altitudes where the cable ties will be constantly exposed to intense solar radiation. Also, as shown in FIG. 3, prior to wrapping the tie member 32 about the sleeve and threading it through the slot 42 in the decking, the tie member can be inserted through a short length of tubular sleeving 44, which is positioned between the tie member and the frame when the tie member is wrapped about the frame and threaded through the slot. The tubular sleeve serves as an abrasion barrier between the tie strip and frame, thus additionally prolonging the life expectancy of the tie member. Whether or not the sleeve is provided on the frame, the single loop construction of the tie member allows the inner portion of the loop to swing about the frame as the decking is flexed upwardly and downwardly during use. As the inner portion of the loop swings, that portion of the loop contacting the frame can slide over the frame. This swinging action allows the tension in the upper and lower portions of the loop to always remain equal, preventing the possibility of overstressing the loop and reducing the chance of premature failure, and also preventing relative sawing movement between the decking and the tie strip, which could cause premature failure of the decking.

In a like manner, the toe decking 20 is fastened to the forward portion of the toe member by a plurality of discrete tie members that are wrapped about the toe member and threaded through spaced slots in the peripheral portion of the toe decking. The toe decking in a like manner is sized to fit within the toe member 16 of the frame. The forward and side peripheral edges of the toe decking are spaced inwardly from the toe member, while the spaced slots in the peripheral portion of the decking are spaced from each other and spaced inwardly from the peripheral edge.

Still referring to FIGS. 1 throughf 4, the rearward end of the toe decking 20 terminates forwardly of the cross member 26. A forwardly extending, semicircularly shaped cut-out portion 46 is provided in the toe decking to serve as a toe hole to allow the toe of the boot and binding positioned on the snowshoe to travel downwardly when the boot is angulated relative to the snowshoe as the wearer walks in the snowshoe. Rearwardly extending tabs 48 remaining at the rearward end of the toe decking on each side of the cut-out 46 are located adjacent opposite sides of the frame. The heel decking at its forward end terminates rearwardly of the cross member 26 and is provided with forwardly extending tabs 50. Tie bars 52 composed of stainless steel wire or other suitable material are formed with an eye at each end. The tie bars are oriented parallel to the longitudinal direction of the snowshoe and are coupled respectively by links 54 and 56 to the rearwardly extending tabs 48 on the toe decking and the forwardly extending tabs 50 on the heel decking to interconnect the heel and toe decking with each other. The interconnection between the toe decking 20 and the heel decking 18 provided by the tie bars 52 prevents the toe member 16 of the frame from sliding forwardly relative to the heel member 14 of the frame and thus holds the toe and heel members in telescoped relationship against the stop provided in the heel member.

Each of the tie bars 52 extends through apertures 58 provided in the downwardly turned claw portion 34 of the cross member. The apertures 58 are of a somewhat larger diameter than the outside diameter of the tie bars 52, allowing free fore and aft movement of the cross member 26 during adjustment relative to the heel and toe decking without disturbing the decking interconnection or the relationship of the decking to the frame. As previously stated, the binding 36 is directly affixed to the cross member. Since the cross member is adjustable and since there is no interconnection between the cross member and the toe and heel decking, the longitudinal and canted position of the binding 36 can be easily adjusted without disturbing the snowshoe structure by simply releasing the clamping bolts on the collar clamps 28 and 30, adjusting the position of the cross member 26, and re-tightening the clamping bolts.

The decking material itself is preferably a resin-impregnated woven fabric composed of nylon monofilament threads or yarns that are woven into a fabric and impregnated with a synthetic elastomer such as neoprene. The preferred material for the decking is characterized by an ability to stretch in one direction and to be relatively inelastic in an orthogonal direction. As positioned on the snowshoe, the decking material is oriented so that it will stretch in the transverse direction of the snowshoe but will not stretch in the longitudinal direction of the snowshoe. This characteristic of the decking provides excellent longitudinal stability on the snowshoe and allows the toe and heel members of the frame to be held together by the interconnection of the decking. However if the wearer of the snowshoe steps on an object protruding from the ground, the decking has the capability of stretching to conform to that object and thus will not place undue stress on the decking or on the tie members. A more important advantage of this type of material for decking is that the tear strength of the material at the slots 42, that is, the amount of force required to rip the peripheral portion of the decking by a pulling force on a tie member threaded through a slot, is greater than the breaking strength of the tie members themselves, thus preventing rupture of the decking while allowing the easily replaceable tie members to fail.

Figure 6:
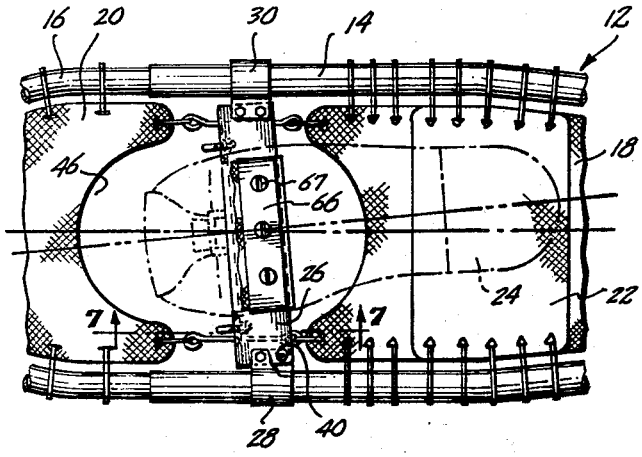
FIG. 6 is a top view of the snowshoe of the present invention showing the frame cross member canted relative to the longitudinal axis of the snowshoe.

Referring to FIGS. 1 and 6, a wear pad is provided by positioning a reinforcing layer of decking material on the heel decking immediately below the position of a boot heel when it is positioned in the binding. Thus the heel decking is protected from excessive abrasion as the wearer of the snowshoe returns his boot to the rest or anatomical position on the decking. It is preferred that the orientation of the heel wear pad be such that the reinforcing pad stretches in the longitudinal direction relative to the snowshoe but not in the transverse direction. Thus, pressure of the heel on the decking will not cause the decking to deform into the snow and also, when the heel decking encounters a hard object, will not cause undue abrasion of the bottom surface of the heel decking.

Referring now to FIGS. 2, 5, 7 and 8, the binding 36 can be characterized as a modified "H" snowshoe binding. The binding 36 is composed of a tongue or toe piece 60, a toe strap 62 and a heel strap 64. The toe piece is a flexible piece of material and can be composed of the same material as the decking. The bottom end of the toe piece is positioned adjacent the bottom side of the cross member 26. From that location the tongue is wrapped around the back side of the cross member and is extended forwardly along the sole of a boot, upwardly around the toe of a boot and rearwardly over the boot upper. The upper end of the tongue terminates adjacent the bottom lacings on the boot. A pivot plate 66 is positioned on top of the cross member 26 so that the portion of the tongue overlying the upper surface of the cross member 26 is sandwiched between pivot plate 66 and the cross member 26. Fasteners 67 extend through mutually aligned holes from the top of the pivot plate 66, through the portion of the tongue on top of the cross member 26, through the cross member 26, and through the portion of the tongue wrapped under the bottom surface of the cross member. The fasteners 67 are then securely fastened to prevent the tongue from slipping away from the cross member. The upper end of the tongue 60 is looped back on itself and is provided with a sliding buckle 68 to allow fore and aft adjustment of the location of the loop at the upper end of the tongue. The upper portion of the toe strap 62 extends through tongue loop to interconnect the toe strap with the tongue 60. Each end of the toe strap is connected to a zinc-plated steel ring 70, one of which is positioned on each side of the boot. Likewise, each end of the heel strap is affixed to the steel ring 70 on each side of the boot. Both the heel strap and the toe strap are of conventional design and incorporate a slide clasp or buckle to allow lengthening or shortening of the heel and toe strap as required for a boot of a given size.

Two eye bolts 72 are positioned adjacent each side of the location of a boot in the binding and extend through bores 74 in the bend or junction between the horizontal portion of the cross member 26 and the claw portion of the cross member 26. The eyes on the bolts 72 are positioned adjacent the forward, upper edge of the cross member 26. Additional bores 76 are provided adjacent each side of the bores 74 for lateral adjustability of the eye bolts 72 relative to the snowshoe frame to accomodate boots of varying width. A link 78 interconnects the eye of the eye bolt 72 with the steel ring 70.

To adjust the binding to a given boot, the boot is inserted in the binding so that the ball of the foot of a wearer resides over the pivot plate 66 on the cross member 26. The location of the loop on the upper end of the tongue 60 is then adjusted to locate the toe strap 62 over the toe of the boot. When the boot is so positioned, the toe portion 60 should be taut when the boot is in its level or rest position on the snowshoe. Thereafter, the toe strap 62 and the heel strap 64 are securely tightened about the boot when it is in its rest position. Preferably, the heel strap is tightened snugly during adjustment of the binding when the boot is raised slightly from the rest position. When the binding is so adjusted, the boot is centered so that the longitudinal direction of the boot is oriented orthogonally to the cross member. If the wearer has a slight toe-in or toe-out in his normal walk, the cant of the cross bar 26 can be adjusted as described above.

Figure 8:
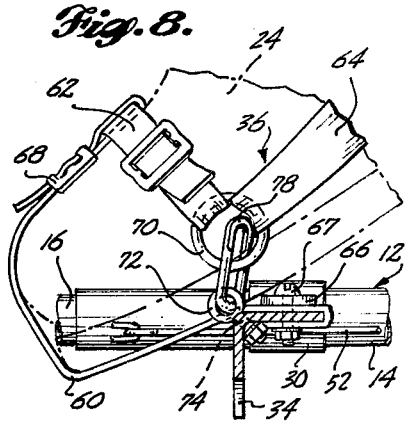
FIG. 8 is a view similar to FIG. 7 but showing the boot in a pivoted position in the binding wherein the binding is loosened to allow lateral heel movement.
Figure 5:
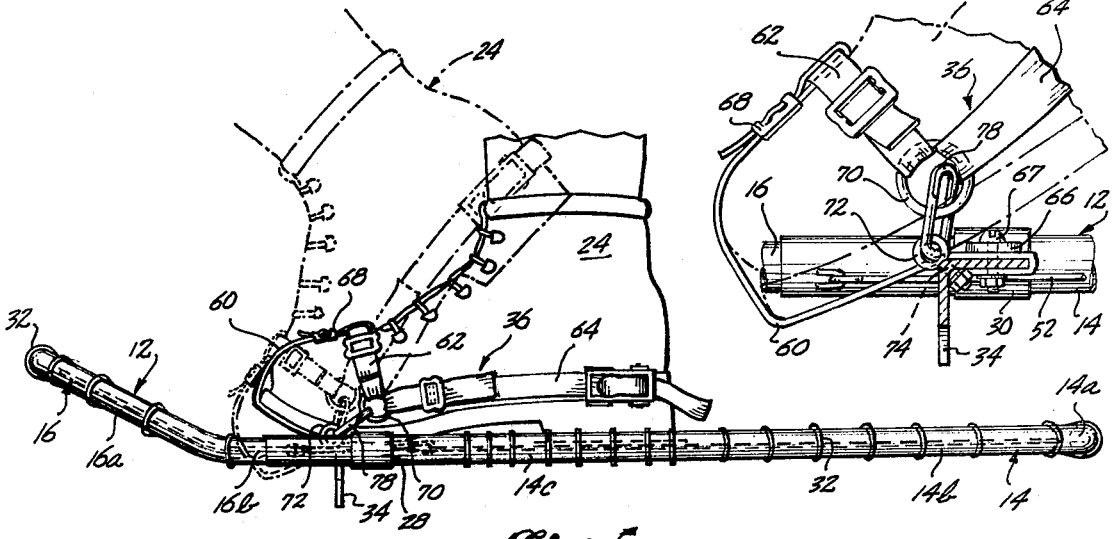
FIG. 5 is a side view of the snowshoe showing a boot positioned in the snowshoe in its rest position and showing a boot pivoted upwardly and forwardly in phantom outline.
Figure 7:
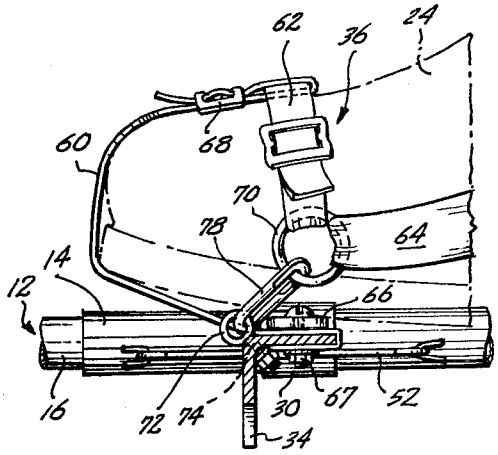
FIG. 7 is an enlarged sectional view of the forward portion of the binding, the cross member and a portion of the frame taken along section line 7—7 of FIG. 6 showing a boot in phantom outline in its rest position in the binding.

An advantage of the binding of the present invention will be described by reference to FIGS. 5, 7 and 8 wherein a boot is illustrated in its rest position and in its angulated position that occurs each time the wearer of the snowshoe takes a step, leaving one leg trailing the other. As the step is taken, the heel of the boot on the trailing leg swings upwardly and forwardly relative to the snowshoe frame. As the boot is so shifted relative to the snowshoe, the sole of the boot rides over the front edge of the pivot plate 66 and actually is lowered relative to the location of the eye bolt 72. As this occurs, the steel ring 70 is brought closer to the location of the eye bolt 72, thereby loosening the grip of the toe strap 62 and heel strap 64 on the boot. Thus when the boot is in its angulated position (shown best in FIG. 8) as opposed to its rest position, the binding straps, especially the heel strap, are sufficiently loosened so that the heel of the boot can be moved laterally, if desired, relative to the snowshoe frame. As the boot is brought back down to its rest position, the boot sole returns to its original position on top of the pivot plate 66, causing the steel rings 70 to rotate or swings back to their normal position as shown in FIG. 7. When the ring 70 is back in its nominal position, the toe and heel straps are tightened, thus securing the boot in a desired orientation whether parallel to or canted relative to the longitudinal direction of the snowshoe frame. The capability to shift the position of the heel of the boot relative to the snowshoe frame provided by the present binding is a significant advantage when traversing a side hill and especially when breaking a trail on a side hill. Shifting of the boot on the snowshow allows more weight to be put on the inside edge of the snowshoe as opposed to the outside edge to maintain the snowshoe substantially horizontal even when on a relatively steep incline. The ability to shift the heel laterally in both directions from a centered position is also an advantage when shifting from a side hill traverse of one slope to a side hill traverse of an opposite slope.

By changing the length of the link 78, the amount of canting available to the wearer can be adjusted, i.e., a longer link 78 will allow greater canting movement. Another advantage of the binding is that during normal traverse over level terrain, the binding will loosen during each forward step, allowing the weight of the snowshoe to drop onto the links 78 to re-center the shoe in the binding, thereby self-aligning the snowshoe on the wearer's boot during each forward step.

After reading the foregoing specification, one of ordinary skill will realize that the objects of the invention have been fulfilled by the snowshoe just described. One of ordinary skill will be able to effect various changes, alterations and substitutions of equivalents without departing from the broad concepts disclosed herein. It is therefore intended that the grant of Letters Patent hereon be limited only by the definition contained in the appended claims and equivalents thereof.

What is claimed is:

1. In a snowshoe having a rigid frame, said frame including a pair of spaced side members, a toe portion and a heel portion, the improvement comprising:

decking having a peripheral portion sized to fit within at least a portion of said frame, said decking having a plurality of spaced apertures in said peripheral portion adjacent said frame, a plurality of discrete tie members passing around at least a portion of said frame, each of said tie members passing through only one of said apertures and being wrapped around said frame to secure said decking to said frame and for positioning said decking between the side members of said frame.

2. The improvement in the snowshoe of claim 1 wherein said decking is a reinforced fabric.

3. The improvement in the showshoe of claim 1 wherein the tear strength of the decking at said aperture exceeds the breaking strength of said tie member.

4. The improvement in the snowshoe of claim 1 wherein each of said tie members forms a closed loop about said frame, said loop passing through a respective one of said apertures.

5. The improvement in the snowshoe of claim 4 wherein each of said tie members has first and second end portions and means for securing together said end portions.

6. The improvement in the snowshoe of claim 4 wherein each of said tie members and said frame are so constructed and arranged relative to each other and so cooperate with each other as to allow said tie members to swing about said frame when said decking is moved relative to said frame.

7. The improvement in the snowshoe of claim 6 wherein each of said tie members slides on said frame as it swings relative thereto.

8. The improvement in the snowshoe of claim 5 wherein each of said tie members is a cable tie.

9. The improvement in the snowshoe of claim 5 wherein each of said tie members is a cable tie composed of a carbon filled, nylon polymer.

10. In a snowshoe having a rigid frame, said frame including spaced side members, a toe portion and a heel portion, said snowshoe having a longitudinal fore and aft dimension, an improvement comprising:

decking sized to fit within at least a portion of said frame and means tieing said decking to said frame, said decking being elastic in the transverse direction relative to said snowshoe and being relatively inelastic in the longitudinal direction relative to said snowshoe.

11. The improvement in the snowshoe of claim 10 wherein said decking is a resin impregnated fabric, said fabric being elastic in the transverse direction and being inelastic in the longitudinal direction.

12. The improvement in the snowshoe of claim 10 further comprising:

a reinforcing layer of decking material superposed on said decking and positioned under the location of a boot heel positioned on said snowshoe, said reinforcing layer being relatively inelastic in the transverse direction relative to said snowshoe.

13. The improvement in the snowshoe of claim 10 wherein said decking includes a forward portion located in the toe portion of said snowshoe and a rearward portion located in the heel portion of said snowshoe, said forward and rearward portions being separated from each other, said improvement further comprising:

means tieing said forward and rearward portions together adjacent each of said side members.

14. The improvement in the snowshoe of claim 13 wherein said means tieing said forward and rearward portions together comprises first and second tie members, each of said tie members comprising a bar extending longitudinally relative to said snowshoe and having forward and rearward ends, said forward and rearward ends being respectively affixed to the forward and rearward portions of said decking to thereby form a longitudinally stable decking structure.

15. A snowshoe comprising:

a frame including spaced side members, a rounded forward member having rearwardly extending portions affixed to said side members and a heel member having forwardly extending portions affixed to said side members, a rigid member extending transversely between said side members, the ends of said rigid member each being respectively positioned adjacent one of said side members, first means releasably coupling one end of said rigid member to one of said side members, and second means releasably coupling the other end of said rigid member to the other of said side members, said first and second means normally securing said rigid member to said frame in fixed relationship and being capable of releasing said rigid member from said frame so that said rigid member can be moved along said side members in the longitudinal direction relative to said snowshoe.

16. The snowshoe of claim 15 wherein said side members include substantially parallel portions, said first and second means releasably coupling said rigid member to said substantially parallel portions.

17. The snowshoe of claim 16 wherein said first and second means are capable of holding said rigid member in orthogonal relationship to said substantially parallel portion.

18. The snowshoe of claim 16 wherein said first and second means are capable of holding said rigid member in canted relationship to said substantially parallel portion.

19. The snowshoe of claim 15 wherein said snowshoe further comprises:

decking sized to fit within at least a portion of the region within said frame, said decking including a forward portion and a rearward portion separated from said forward portion, said rigid member being positioned between said forward and rearward portions, means for securing said forward and rearward portions of said decking to said frame, and means for tieing said forward and rearward portions together.

20. The snowshoe of claim 19 wherein said means for tieing said forward and rearward portions together comprises:

a first tie member tieing the forward end of said rearward portion to the rearward end of said forward portion adjacent one of said side members, and a second tie member tieing the forward end of said rearward portion to the rearward end of said forward portion adjacent the other of said side members, each of said tie members including an intermediate bar portion extending longitudinally relative to said side portions.

21. The snowshoe of claim 19 further comprising a gripping member rigidly affixed to and extending downwardly from said rigid member, said gripping member having first and second apertures therein located below said rigid member, the intermediate bar portions of said first and second tie members extending through respective ones of said first and second apertures, said rigid member being movable relative to said tie members in the longitudinal direction relative to said shoe.

22. In a snowshoe including a frame having spaced side members and toe and heel portions associated with said side members, an improvement comprising:

a cross member extending transversely between said spaced side members adjacent said toe portion, and means affixing said cross member to said side portion, said cross member positioned on said snowshoe so as to reside under the location corresponding to the position of the ball of the foot of a wearer of the snowshoe, a snowshoe binding located adjacent said cross member, and means for connecting said binding to said cross member for swinging movement about an axis oriented transversely relative to said snowshoe, said means and said binding being so constructed and associated with each other to loosen said binding on a boot positioned therein as the heel of said boot swings upwardly and forwardly relative to said snowshoe.

23. In a snowshoe including a frame having spaced side members and toe and heel portions associated with said side members, an improvement comprising:

a cross member extending transversely between said spaced side members adjacent said toe portion and means affixing said cross member to said side members, said cross member positioned on said snowshoe so as to reside under the location corresponding to the position of the ball of the foot of a wearer of said snowshoe, a flexible toe piece having one end affixed to said cross member and a second end adapted for positioning above the toe portion of an upper of a boot positioned in said binding, the intermediate portion of said toe piece adapted to extend forwardly from said cross member under the forward portion of said boot, upwardly around the toe portion of said boot, and rearwardly across the upper of said boot, and terminating in said second end, a first strap adapted to extend transversely over the upper of said boot, said strap being coupled to said flexible toe piece and having ends terminating adjacent said cross member, a second, adjustable strap adapted to extend around the heel of said boot and having ends terminating adjacent respective ends of said first strap on each side of said boot, a first, spaced set of links coupling adjacent ends of said first and second straps on each side of said boot, a second, spaced set of links affixed to said cross member and spaced transversely relative to said snowshoe, said second set links being positioned adjacent respective sides of a boot positioned in said binding, and a set of coupling links each swingably coupling one of said first set of links with one of said second set of links, thereby swingably coupling said binding to said cross member.

24. The improvement in the snowshoe of claim 23 wherein said cross member has a forward upper edge around which a boot positioned in said binding can pivot, the swinging connection between said coupling links and said second set of links being so constructed and arranged to place the pivotal axis of said binding relative to said cross member forwardly and above the forward, upper edge of said cross member, thereby allowing said binding to loosen on a boot positioned therein as the heel of said boot swings upwardly and forwardly relative to said snowshoe.

25. The improvement in the snowshoe of claim 22 wherein said cross member has a forward, upper edge about which a boot positioned in said binding can pivot, said axis being positioned forwardly of said edge.

26. The improvement in the snowshoe of claim 25 wherein said axis is positioned above and forwardly of said upper edge of said cross member.

27. The improvement in the snowshoe of claim 22 wherein said means rigidly affixes said cross member to said side members.

28. A snowshoe frame comprising:

a tubular heel member having a rounded rearward end and forwardly extending, spaced side portions, a tubular toe member having a rounded forward end and rearwardly extending, spaced side portions, the spaced side portions of one of said members telescopically engaging respective spaced side portions of the other of said members, stop means associated with one of said members for limiting the extent of telescopic engagement of said members, and a rigid cross member extending transversely between said side portions and rigidly affixed thereto, said rigid cross member including attachment means for releasably affixing said rigid cross member to the side portions of one of said toe and heel members, said attachment means capable of holding said cross member in rigid relationship to said side portions and for releasing said cross member from said side portions so that said cross member can be adjustably moved along said side portions in the longitudinal direction of said snowshoe.

29. The snowshoe frame of claim 28 wherein said means releasably affixing said cross member to said side portions will allow said cross member to be held in orthogonal relationship relative to the longitudinal direction of said snowshoe and will allow said cross member to be canted from said orthogonal relationship.

30. In a snowshoe having a rigid frame, said frame including a pair of spaced side members, a toe portion and a heel portion, the improvement comprising:

decking having a peripheral portion sized to fit within at least a portion of said frame, said decking having a plurality of spaced apertures in said peripheral portion adjacent said frame, said decking comprising a closely woven, reinforced fabric, said fabric being elastic in the transverse direction relative to said snowshoe and being inelastic in the longitudinal direction relative to said snowshoe, a plurality of discrete tie members passing around at least a portion of said frame, each of said tie members passing through one of said apertures and being wrapped around said frame to secure said decking to said frame and for positioning said decking between the side members of said frame.

31. In a snowshoe having a rigid frame, said frame including a pair of spaced side members, a toe portion and a heel portion, the improvement comprising:

decking having a peripheral portion sized to fit within at least a portion of said frame, said decking having a plurality of spaced apertures in said peripheral portion adjacent said frame, said apertures each being a slot, each of said slots being oriented substantially parallel to the respective adjacent portion of said frame, a plurality of discrete tie members passing around at least a portion of said frame, each of said tie members passing through one of said slots and being wrapped around said frame to secure said decking to said frame and for positioning said decking between the side members of said frame.

32. In a snowshoe having a rigid frame, said frame including a pair of spaced side members, a toe portion and a heel portion, the improvement comprising:

decking having a peripheral portion sized to fit within at least a portion of said frame, said decking having a plurality of spaced apertures in said peripheral portion adjacent said frame, a plurality of discrete tie members passing around at least a portion of said frame, each of said tie members passing through only one of said apertures and being wrapped around said frame to secure said decking to said frame and for positioning said decking between the side members of said frame, each of said tie members being an elongated strip of material having a longitudinal extent, a transverse dimension and a thickness, the thickness of said strip being substantially less than said transverse dimension.

33. In a snowshoe having a rigid frame, said frame including a pair of spaced side members, a toe portion and a heel portion, the improvement comprising:

decking having a peripheral portion sized to fit within at least a portion of said frame, said decking having a plurality of spaced apertures in said peripheral portion adjacent said frame, a plurality of discrete tie members passing around at least a portion of said frame, each of said tie members passing through one of said apertures and being wrapped around said frame to secure said decking to said frame, and for positioning said decking between the side members of said frame, and a sleeve disposed about at least a portion of each of said tie members passing around said frame, said sleeve forming a protective shield for each of said tie members.

34. A snowshoe frame comprising:

a tubular heel member having a rounded rearward end and forwardly extending, spaced side portions, a tubular toe member having a rounded forward end and rearwardly extending, spaced side portions, the spaced side portions of one of said members telescopically engaging respective spaced side portions of the other of said members, stop means associated with one of said members for limiting the extent of telescopic engagement of said members, a decking sized to fit between said side portions and having separate toe and heel portions, means for affixing said toe and heel portions to respective ones of said toe and heel members, and means for affixing the toe portion to the heel portion to prevent separation of the toe and heel portions in the longitudinal direction of the snowshoe and for maintaining said toe and heel members in telescoped relationship against said stop means.

* * * * *